US008572815B1

(12) United States Patent
Ivankoe et al.

(10) Patent No.: US 8,572,815 B1
(45) Date of Patent: Nov. 5, 2013

(54) UNIVERSAL TIE DOWN ASSEMBLY

(75) Inventors: Eugene Michael Ivankoe, Chatham, NJ (US); Robert Golz, Swansea, MA (US); Margaret Wilson, Great Meadows, NJ (US); Edward Recke, Brighton, MI (US); Aaron Hemphill, Blairmore (CA)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/609,836

(22) Filed: Sep. 11, 2012

Related U.S. Application Data

(60) Provisional application No. 61/585,759, filed on Jan. 12, 2012.

(51) Int. Cl.
*A44B 11/25* (2006.01)

(52) U.S. Cl.
USPC ..... 24/302; 24/165; 24/182

(58) Field of Classification Search
USPC ..... 24/302, 248, 301, 300, 165, 182, 2.5; 224/600, 625
See application file for complete search history.

(56) References Cited

U.S. PATENT DOCUMENTS

| | | | | | |
|---|---|---|---|---|---|
| 3,241,206 | A * | 3/1966 | Greenfield | 24/646 |
| 5,423,644 | A * | 6/1995 | First, Sr. | 410/100 |
| 5,608,951 | A * | 3/1997 | Chou | 24/302 |
| 5,809,620 | A * | 9/1998 | Crowley et al. | 24/302 |
| 5,947,354 | A * | 9/1999 | Williams | 224/318 |
| 6,318,612 | B1 * | 11/2001 | MacNeil | 224/572 |
| 7,849,568 | B2 * | 12/2010 | Wilkinson | 24/298 |
| 2010/0071173 | A1 * | 3/2010 | Hortnagl | 24/651 |

* cited by examiner

*Primary Examiner* — Robert J Sandy
*Assistant Examiner* — Abigail E Morrell
(74) *Attorney, Agent, or Firm* — Henry S. Goldfine

(57) ABSTRACT

A universal tie down assembly includes first and second longitudinal belts comprising reinforced webbing made from a flexible fabric material. Each belt includes a buckle end and an anchor end. The anchor end is a loop of the reinforced webbing. At least one longitudinal slot is woven into an edge of at least one of the belts. The length of the slot is at least as great as the width of the belts. The assembly includes a novel open under load buckle having a receiving part (female part) and an insertion part (male part). The buckle end of one of the belts is adjustably disposed in a belt opening of one of the insertion part and the receiving part and the buckle end of the other of the belts forms a sewn loop that loops through a belt opening of the other of the insertion part and the receiving part.

18 Claims, 8 Drawing Sheets

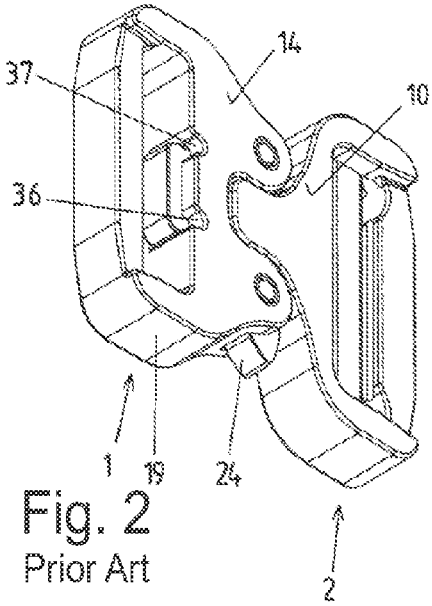
Fig. 2
Prior Art
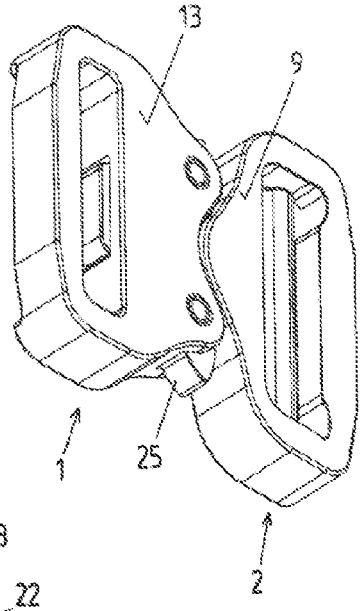
Fig. 1
Prior Art
Fig. 3
Prior Art
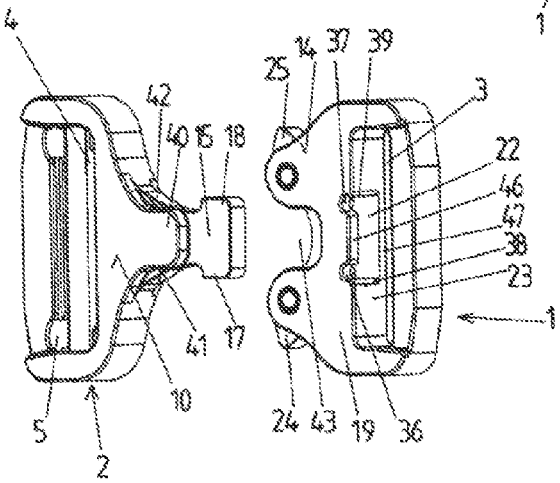
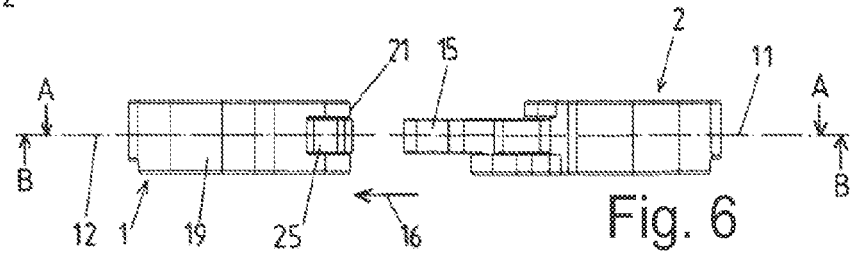
Fig. 6
Prior Art

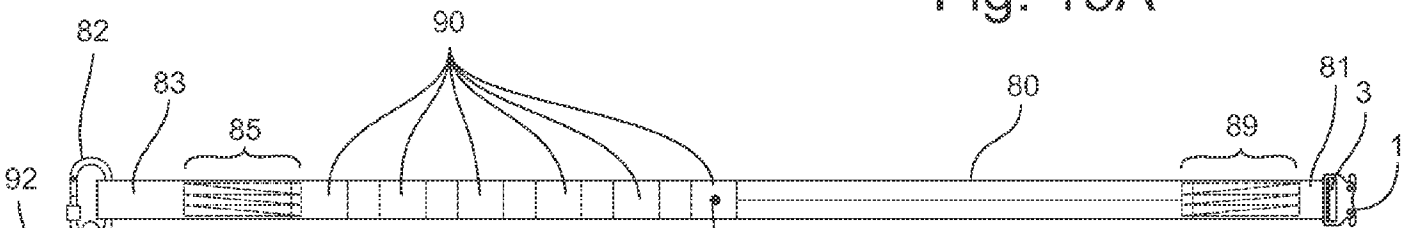
Fig. 15A
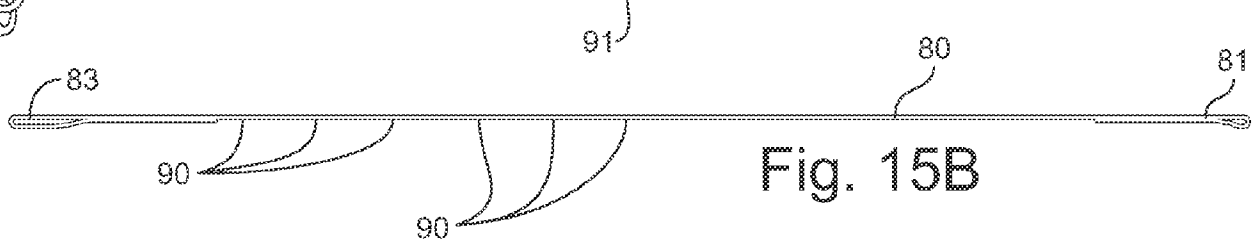
Fig. 15B
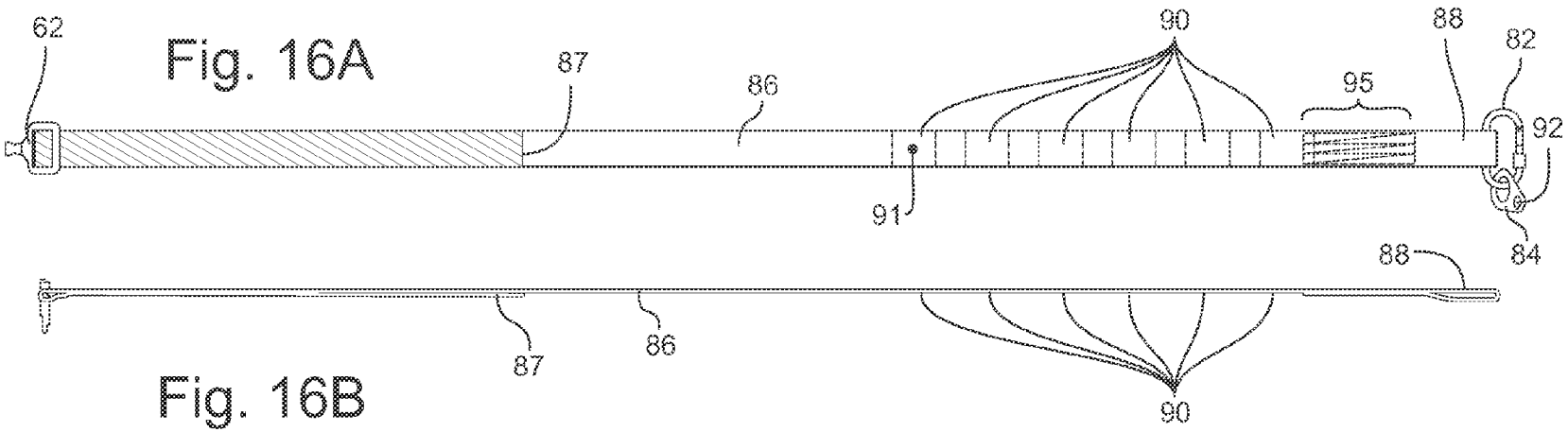
Fig. 16A
Fig. 16B

UNIVERSAL TIE DOWN ASSEMBLY

CROSS-REFERENCE TO RELATED APPLICATIONS

The present application claims the benefit of priority of U.S. provisional patent application Ser. No. 61/585,759 filed on Jan. 12, 2012, which is incorporated by reference herein.

STATEMENT OF GOVERNMENT INTEREST

The invention described herein may be manufactured, used and licensed by or for the United States Government.

BACKGROUND OF THE INVENTION

The invention relates in general to tie downs for attaching and securing equipment and in particular to tie downs for attaching and securing equipment to the interior or exterior of vehicles.

Various tie downs are known for securing equipment to the interior or exterior of a vehicle. Some tie down methods use cargo webbing with ratcheting buckles, netting, and elastic cord (bungee cord). The known tie downs vary in safety, adaptability to different vehicles, and ease of use. In some environments, stowage of equipment and gear is a critical issue because the available space is very limited. Furthermore, failure of the tie down can result in property damage, injury, or death. A particularly harsh environment is a military theater of operations. Storage space, particularly interior storage space, is at a premium in armored vehicles that transport personnel and/or cargo. In addition, the armored vehicle may be subject to extreme shocks, such as shocks from substandard roads, hostile fire, and rollovers caused by explosive devices such as improvised explosive devices (IEDs). In such a harsh environment, the reliability of the tie downs and ease of use of the tie downs in cramped areas are critical factors.

Some buckles used with tie downs may be opened only when the buckle is not under load. A buckle that is designed to not open under load is described in U.S. Patent Application Publication 2010/0071173 published on Mar. 25, 2010 in the name of Hortnagl. The entire contents of U.S. Patent Application Publication 2010/0071173 are expressly incorporated by reference herein. When buckles are used as part of a support for a human being, it is very important that the buckles not open under load. Otherwise, serious injury or death of the human may occur. On the other hand, in some cargo securing applications, it may be desirable to use a buckle that will open under load, for example, to save time in an emergency situation.

A need exists for a tie down that is safe, reliable, easy to use, readily adaptable to various configurations, and that includes an open under load buckle.

SUMMARY OF THE INVENTION

One aspect of the invention is a universal tie down assembly including first and second longitudinal belts. The belts are reinforced webbing made from a flexible fabric material. Each belt has a buckle end and an anchor end. Each anchor end is a loop of the reinforced webbing. At least one longitudinal slot is woven into an edge of at least one of the first and second belts. The length of the slot is at least as great as the width of the belts. The assembly includes an open under load buckle.

The open under load buckle has an insertion part and a receiving part. The insertion part has a central longitudinal axis, at least one belt opening for guiding a belt, and an insertion appendage extending in a direction of insertion with holding catches protruding from both sides of the insertion appendage in a direction perpendicular to the direction of insertion.

The receiving part has at least one belt opening for guiding a belt, and a basic body. The basic body includes an insertion opening for receiving the insertion appendage of the insertion part. Latches are pivotally mounted to the basic body. In a locking position with the insertion part inserted in the receiving part, the latches cooperate with the holding catches of the insertion appendage and retain the insertion appendage in the insertion opening of the receiving part.

The insertion opening begins at the inserting side of the basic body and forms a penetrating opening into the basic body to the belt opening. Guiding surfaces in the basic body for the two holding catches of the insertion appendage point to two edge surfaces in the perpendicular direction, which limit the penetrating opening of the basic body at both sides in the perpendicular direction in an area where the penetrating opening opens into the belt opening.

Each holding catch includes a surface for engaging a respective one of the latches. This surface includes a planar portion that extends from a portion of the holding catch most distant from the central longitudinal axis inwardly towards the central longitudinal axis. The planar portion forms an acute angle with the central longitudinal axis. The acute angle is in a range of 55 to 62 degrees. The surface also includes a rounded portion that connects the planar portion with a side of the insertion appendage.

The buckle end of one of the belts is adjustably disposed in a belt opening of one of the insertion part and the receiving part and the buckle end of the other of the belts forms a sewn loop that loops through the a belt opening of the other of the insertion part and the receiving part.

The at least one longitudinal slot may include a plurality of longitudinal slots woven into the edge of at least one of the first and second belts.

A locking carabiner may be included at each anchor end loop. The anchor end loops may be looped through the locking carabiners. Anchors may be provided at each anchor end loop with the locking carabiners being looped through the anchors.

Another aspect of the invention is a method of anchoring the universal tie down assembly. The method includes looping the anchor end of one of the first and second belts around a support member, and then guiding the anchor end through the plurality of longitudinal slots in the belt.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIGS. 1 and 2 are perspective views of a known belt buckle with the insertion part inserted in the receiving part.

FIG. 3 is a perspective view of the buckle of FIGS. 1 and 2 with the insertion part removed from the receiving part.

FIG. 6 is an edge view of FIG. 4.

FIG. 15A is a top view of one half of a universal tie down assembly.

FIG. 15B is a side view of FIG. 15A, without the carabiner, anchor and receiving part.

FIG. 16A is a top view of the other half of the universal tie down assembly of FIG. 15A.

FIG. 16B is a side view of FIG. 16A, without the carabiner and anchor.

DETAILED DESCRIPTION

Figure 5:
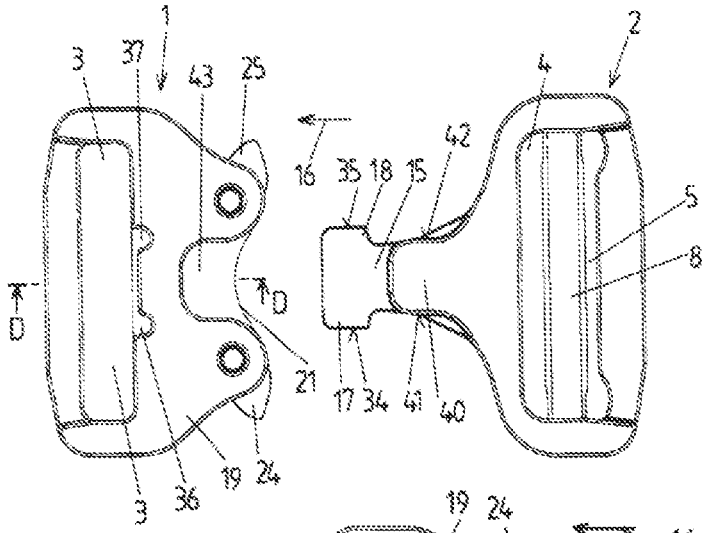
Fig. 5 Prior Art
FIGS. 4 and 5 are side views of the frontal and the rear lateral surfaces of the buckle of FIGS. 1 and 2 with the insertion part separated from the receiving part.
Figure 4:
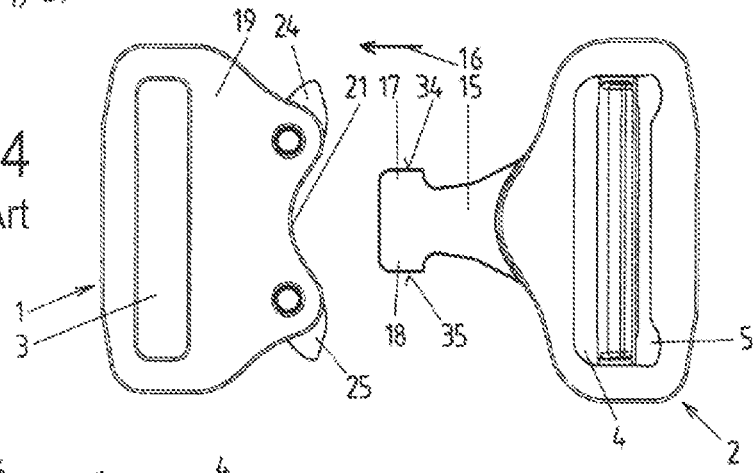
Fig. 4 Prior Art
Figure 8:
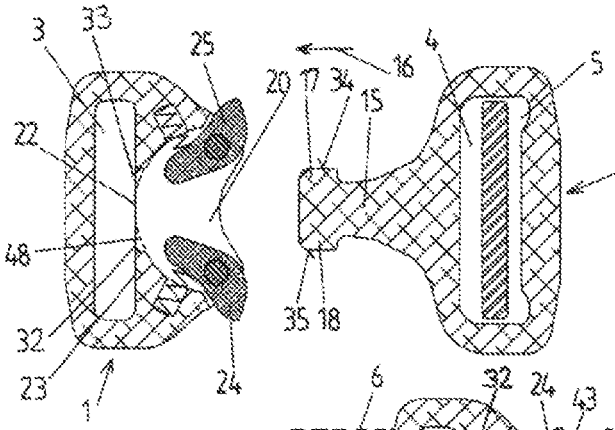
Fig. 8 Prior Art
FIGS. 7 and 8 are cross-sections along the lines AA and BB of FIG. 6.

U.S. Patent Application Publication 2010/0071173 discloses a buckle that does not open under load. As shown in FIGS. 1-12, the buckle of U.S. Patent Application Publication 2010/0071173 includes a receiving part 1 (female buckle part) and an insertion part 2 (male buckle part) that interlock with each other in the inserted state. The receiving part 1 and the insertion part 2 are each provided with at least one belt opening 3, 4, 5 (FIG. 4) for guiding belts 6, 7 (FIGS. 7 and 12) that are connected with the receiving part 1 and/or the insertion part 2. The belts 6, 7 are indicated by dot-dash lines in FIGS. 7 and 12. In the exemplary embodiment shown, the receiving part 1 has only one belt opening 3 to connect a belt 6 in a fixed manner to the receiving part 1 (by guiding it through the belt opening 3 and sewing it), while the insertion part 2 has two belt openings 4, 5, located at both sides of a displaceable central bar 8, in order to connect a belt 7 to the insertion part 2 in an adjustable fashion. The end of the belt 7 is pulled in a known manner from the rear lateral surface 10 (FIG. 2) of the insertion part 2 through the belt opening 4, over the central bar 8, and further through the belt opening 5.

In contrast to FIGS. 1-12, both the receiving part 1 as well as the insertion part 2 may be provided with one belt opening only for a fixed mounting of an end of the belt, or both the insertion part as well as the receiving part may include several belt openings for an adjustable connection to a belt. The inverse arrangements is also possible, with one end of the belt being connected to the receiving part 1 in an adjustable fashion and one end of the belt to the insertion part 2 in a fixed manner.

The belts 6, 7 connected to the receiving part 1 and the insertion part 2 may also represent separate belts or the two ends of a single belt.

The insertion part 2 has a primary plane 11 (FIG. 6). The frontal and the rear lateral surfaces 9, 10 are located parallel in reference to the primary plane 11 and/or have sections positioned parallel in reference to the primary plane 11. The receiving part 1 has a primary plane 12. The frontal and the rear lateral surface 13, 14 of the receiving part 1 are located parallel in reference to the primary plane 12 and/or have sections positioned parallel in reference to the primary plane 12.

In the inserted state of the receiving part 1 and the insertion part 2, the primary planes 11, 12 of the insertion part 2 and the receiving part 1 are positioned in and/or define a common plane.

The axes of the belt openings 3, 4, 5 are positioned at a right angle in reference to the primary planes 12, 11.

The receiving part 1 and the insertion part 2 may be made of a metal, for example, aluminum.

Beginning at one of the sections of the insertion part 2 forming the belt openings 4, 5, an insertion appendage 15 of the insertion part 2 extends, in a direction of insertion 16. In the area of a free end, frontal in reference to the direction of insertion 16, the insertion appendage 15 has holding catches 17, 18, which are arranged at both sides at the insertion appendage 15. The holding catches 17, 18 each project in a perpendicular direction aligned at a right angle in reference to the direction of insertion 16 and parallel in reference to the primary plane 11. The perpendicular direction is the direction, in which the belt openings 3, 4, 5 determine the maximum width of the belt.

The receiving part 1 has a basic body 19, in which the belt opening 3 is embodied. The basic body 19 is further provided with an insertion opening 20, in which the insertion appendage 15 of the insertion part 2 is inserted in the direction of insertion 16, when the two parts 1, 2 of the buckle are connected to each other. The insertion opening 20 begins at the inserting side 21 of the receiving part 1, which is the narrow side of the receiving part 1 facing the insertion part 2 to be inserted. The insertion opening 20 is embodied as a penetrating opening penetrating the basic body 19 to the belt opening 3, i.e. it opens on the one hand at the inserting side 21 of the basic body 19 and on the other side into the belt opening 3, with a window 22 being formed in the limiting surface 23 of the belt opening 3 (cf. particularly FIG. 3). Measured in the perpendicular direction the width of this window 22 is narrower, i.e. less than half the size than the width of the belt opening 3 measured in the perpendicular direction. In other words, the basic body 19 of the receiving part 1 has a channel, which on the one side opens at the inserting side 21 and forms the insertion opening 20 and on the other side opens in the belt opening 3 and here forms a window 22, which is embodied in the limiting surface 23 of the belt opening 3, limiting the belt opening 3 at the side facing the inserting side 21.

First and second latches 24, 25 are pivotally mounted to the basic body 19 of the receiving part 1. The pivoting axes 26, 27 are aligned at a right angle in reference to the direction of insertion 16 and at a right angle in reference to the perpendicular direction, thus they are positioned at a right angle in reference to the primary plane 12. In the state of the parts 1, 2 of the buckle inserted into each other and interlocked, the latches 24, 25 are in a locking position, in which they cooperate with the holding catches 17, 18. By engaging the holding catches 17, 18 they block the insertion appendages 15 from being pulled out of the insertion opening 20 against the direction of insertion 16. The latches 24, 25 are impinged in the locking position by spring elements 28, 29. In the exemplary embodiment shown the spring elements 28, 29 represent coil springs projecting from blind bores of the basic body 19 into the penetrating opening of the basic body 19 and also supported on the one side at the bottom of the blind bore and on the other side at the latch. The latches 24, 25 are two-armed levers. By engaging the lever arms projecting from the basic body 19 (the forces to be applied are symbolized by the arrows 30, 31 in FIG. 12), the latches 24, 25 are pivoted around their axes into the opening position, in which they release the holding catches 17, 18, allowing the insertion appendage 15 to be pulled out of the insertion opening 20.

In order to connect the separated parts 1, 2 of the buckle, the insertion part 2 is inserted into the insertion opening 20. The front end of the insertion appendage 15 approaches the lever arms of the latches 24, 25 located inside the basic body 19 and forcefully separates them by pivoting the latches 24, 25 around their pivotal axes 26, 27 against the force of the spring elements 28, 29 until the latches 24, 25 engage behind the fastening catches 17, 18 in the entirely inserted state of the insertion part 2.

In the area of the entrance of the penetrating opening of the basic body 19 and/or the channel through the basic body 19 in the belt opening 3, i.e., in the area adjacent to the window 22, the penetrating opening of the basic body 19 and/or the channel through the basic body 19 is limited in the perpendicular direction at both sides by guiding surfaces 32, 33. These guiding surfaces 32, 33 serve to guide the edge surfaces 34, 35 of the holding catches 17, 18 pointing in the perpendicular direction. The guiding surfaces 32, 33 therefore counteract a displacement of the edge surfaces 34, 35 in the perpendicular direction, with it representing a planar support for the edge surfaces 34, 35 and not simply representing edges.

The guiding surfaces 32, 33 and the sections of the edge surfaces 34, 35 cooperating with them are preferably located in planes with their normal surface being positioned essentially parallel to the perpendicular direction.

For a simple embodiment of the penetrating opening through the basic body 19 with the guiding surfaces 32, 33, which is explained in greater detail in the following, the limiting surface 23 of the belt opening 3, in which the window 22 is embodied, is provided with first and second recesses 36, 37. The recesses 36, 37 begin at the window 22, namely they penetrate one of the two walls 46, 47 (cf. FIGS. 3 and 13), which are located between the penetrating opening through the basic body 19 of the receiving part 1 and the lateral surface 13, 14 of the receiving part 1. Faces of the recesses 36, 37 form sections of the limiting surface 23 of the belt opening 3, with both of them penetrating the same wall 46 and are distanced in reference to the perpendicular direction. In reference to the perpendicular direction, a respective recess 36, 37 follows adjacent to the respective two lateral edges 38, 39 limiting the window 22 in the perpendicular direction and extend, beginning at the respective lateral edge 38, 39, in the direction to the other lateral edge 38, 39.

Figure 7:
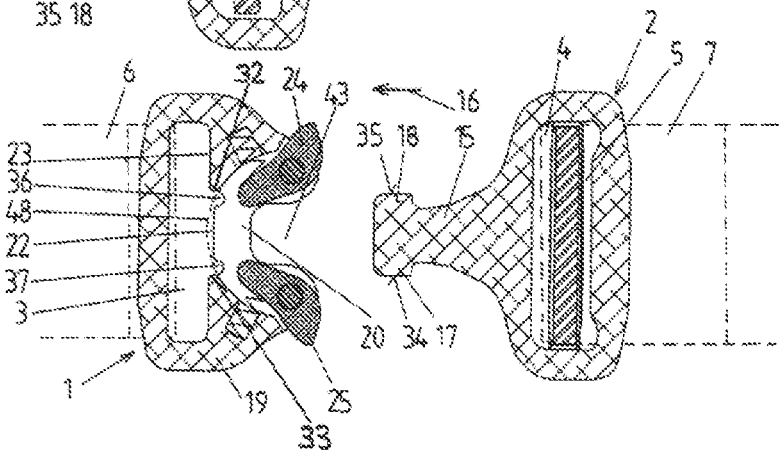
Fig. 7 Prior Art
Figure 10:
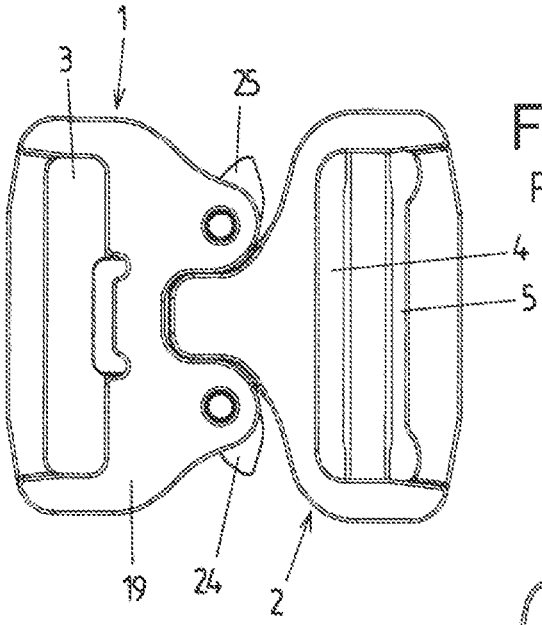
Fig. 10 Prior Art
FIGS. 9 through 11 are views according to FIGS. 4 through 6 in the inserted state of the insertion part and the receiving part.
Figure 9:
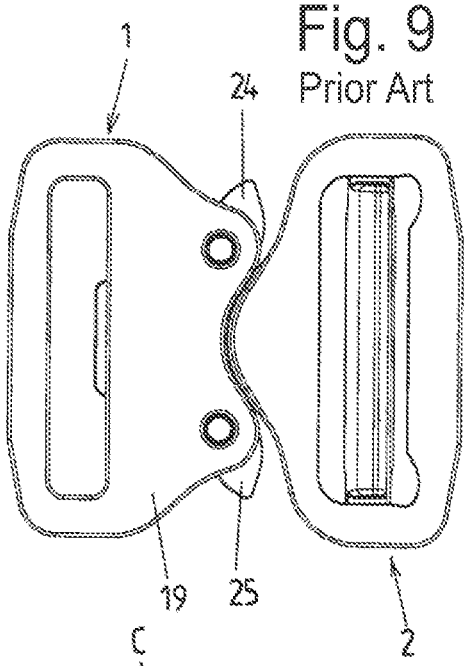
Fig. 9 Prior Art
Figure 11:
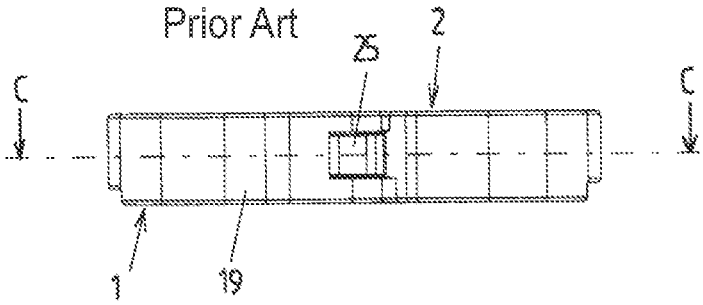
Fig. 11 Prior Art
Figure 12:
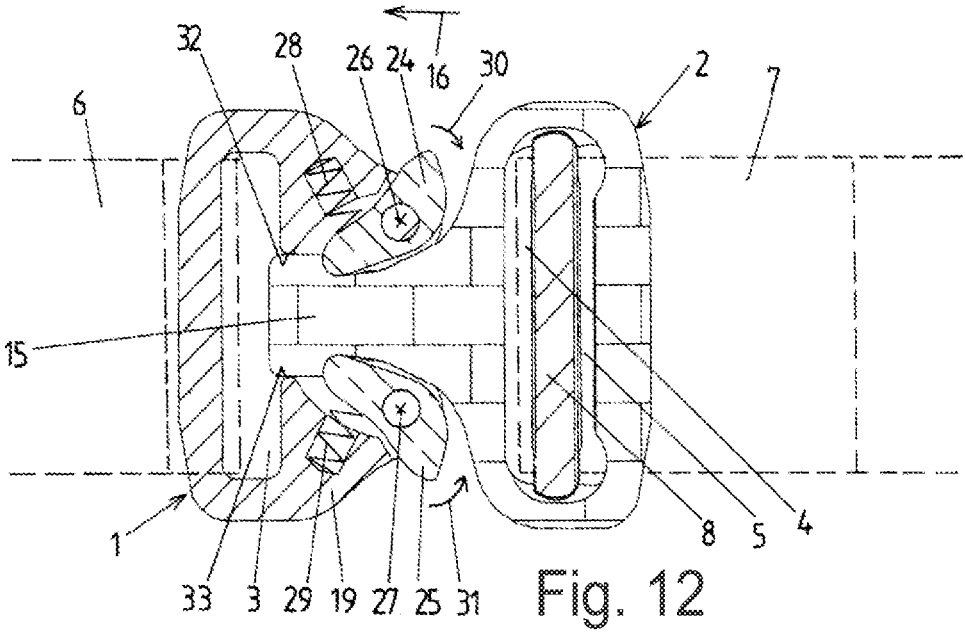
Fig. 12 Prior Art
FIG. 12 is a cross-section along the line CC of FIG. 11.
Figure 14:
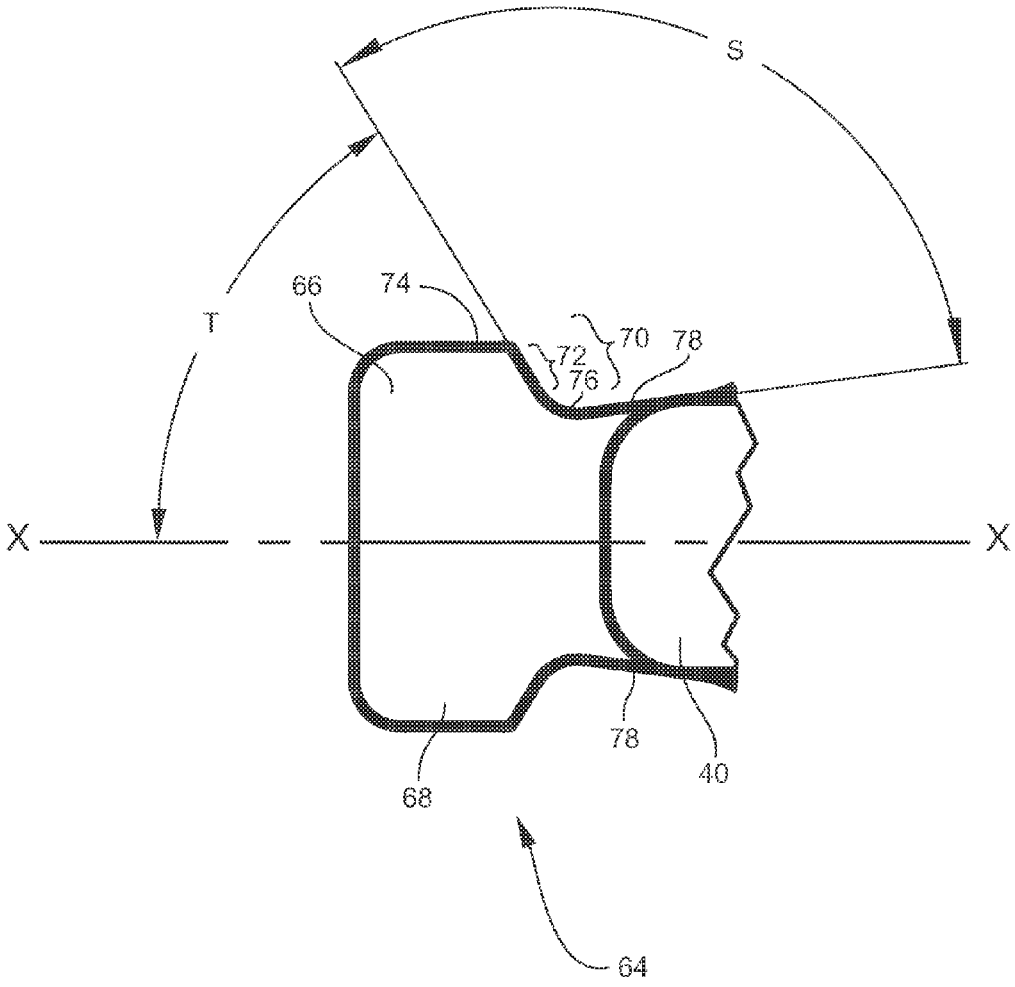
FIG. 14 is an enlarged view of a portion of FIG. 13.
Figure 17:
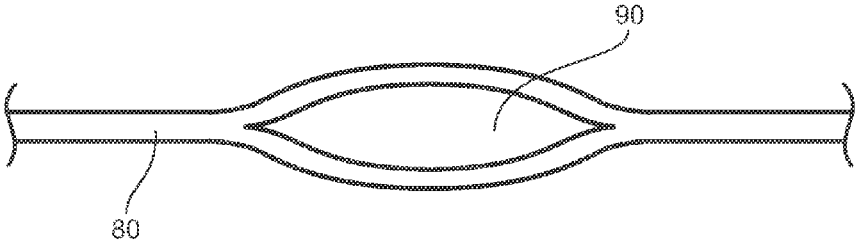
FIG. 17 is an enlarged view of a portion of FIG. 15A showing a slot.

The lateral wall 46 can be slightly spaced apart from the face pointing to the window 22 between the first and the second recess 36, 37, as discernible from FIGS. 7 and 14, for example.

If desired, third and fourth recesses may be embodied in the other wall 47 in a similar fashion as in the first and second recesses 36, 37.

A stop 40 is formed at the insertion appendage 15, provided with edge surfaces 41, 42, which are positioned at a right angle in reference to the primary plane 12 and point in the perpendicular direction. The edge surfaces 41, 42 of the stop 40 cooperate with the edges of a guiding recess 43 beginning at the inserting side 21 of the basic body 19 of the receiving part 1, with a guidance being formed for the insertion appendage 15. This guidance counteracts any displacement of the insertion appendage 15 in the perpendicular direction in the area of this guidance. Preferably the edge surfaces 41, 42 are positioned in planes with their normal surfaces essentially being positioned parallel in reference to the perpendicular direction.

The guidance of the insertion appendage 15, on the one hand, through the guidance surface 32, 33 and, on the other hand, through the edge surfaces 41, 42, achieves an advantageous guidance of the insertion appendage 15, with these two guides being spaced apart in the direction of insertion 16, resulting in little play of the insertion part 2 in reference to the receiving part 1 with regard to a tilting around an axis positioned at a right angle in reference to the primary plane 11, 12 in an inserted state of the two parts 1, 2 of the buckle.

Advantageously, the insertion appendage 15 of the insertion part 2 protrudes slightly from the window 22 in the inserted state of the two parts 1, 2 of the buckle, preferably at least 1 mm. Thus the guiding surfaces 32, 33 can be maximally utilized in spite of rounded edges in the area of the front end of the insertion appendage 15 in reference to the direction of insertion 16 and in spite of the existing play of the insertion part 2 in reference to the receiving part 1 in the inserted state.

Figure 13:
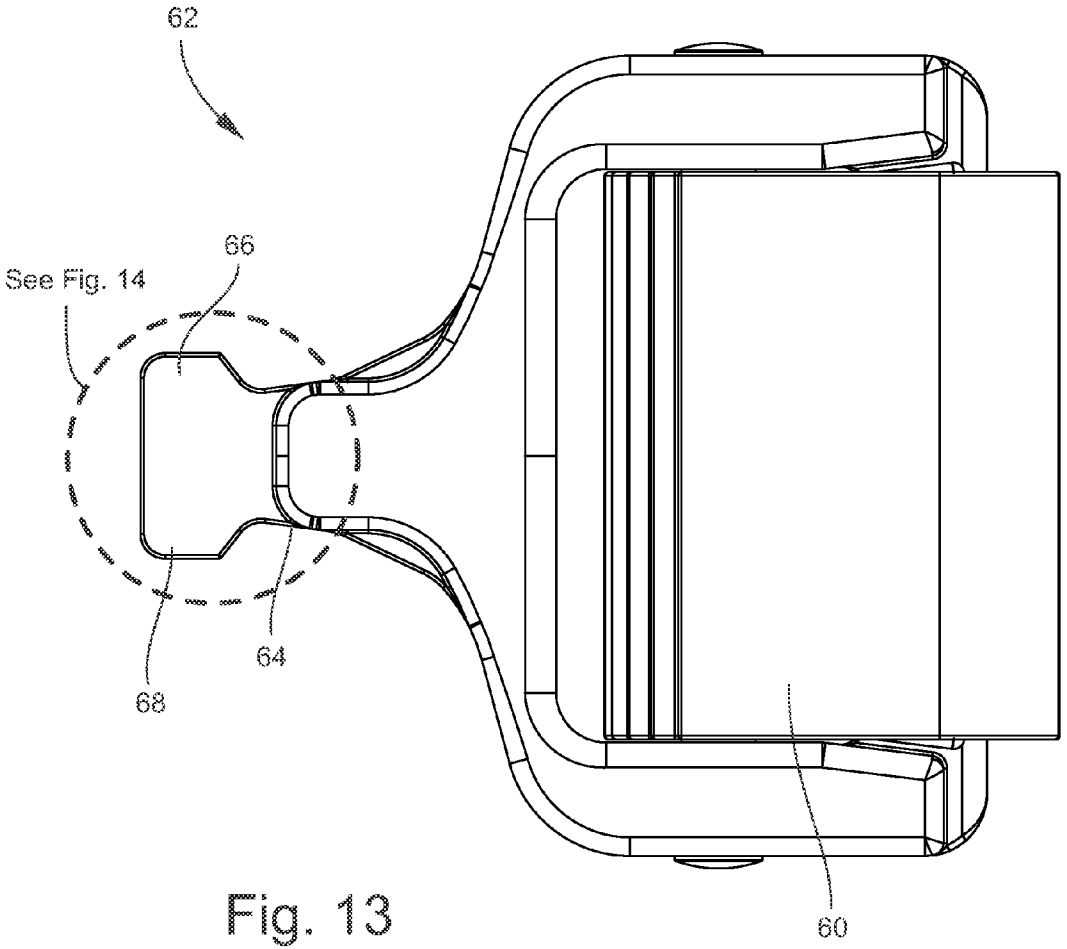
FIG. 13 is a side view of the rear lateral surface of the insertion part of an open under load buckle, oriented like the insertion part of FIG. 5.

The mating buckle parts 1, 2 are designed to not open under load. Otherwise, the buckle would not be acceptable for many uses. FIG. 13 shows a novel insertion part 62. Insertion part 62 may be used with receiving part 1 to form a novel open under load buckle. Insertion part 62 includes an insertion appendage 64 that differs from insertion appendage 15 of FIGS. 1-12. FIG. 14 is an enlarged view of insertion appendage 64 showing holding catches 66, 68 arranged at both sides of insertion appendage 64. Holding catches 66, 68 each project perpendicularly to a central longitudinal axis XX of insertion part 62. Holding catches 66, 68 engage latches 25, 24 (FIG. 5) when insertion part 62 is inserted fully into receiving part 1 (FIG. 5). Because insertion appendage 64 is symmetric about axis XX, only one holding catch 66 will be described.

Holding catch 66 includes a surface 70 for engaging latch 25 (FIG. 5). Surface 70 includes a planar portion 72 that extends from a portion 74 of holding catch 66 that is most distant from central longitudinal axis XX. Planar portion 72 extends inwardly towards central longitudinal axis XX. Planar portion 72 forms an acute angle T with central longitudinal axis XX. Surface 70 includes a rounded portion 76 that connects planar portion 72 with a side 78 of insertion appendage 64. Angle T may be in a range of 51-66 degrees, more preferably in a range of 55-62 degrees, and most preferably in a range of 58-59 degrees. In one embodiment, an angle S between planar portion 72 and side 78 of insertion appendage 64 is about 114 degrees.

FIG. 15A is a top view of one half of a universal tie down assembly, including a longitudinal belt 80 having a buckle end 81 and an anchor end 83, receiving part 1, a locking carabiner 82, and an anchor 84. FIG. 15B is a side view of FIG. 15A, without carabiner 82, anchor 84, and receiving part 1. FIG. 16A is a top view of the other half of the universal tie down assembly, including a longitudinal belt 86 having a buckle end 87 and an anchor end 88, insertion part 62, a locking carabiner 82, and an anchor 84. FIG. 16B is a side view of FIG. 16A, without carabiner 82 and anchor 84.

Belts 80, 86 are reinforced webbing made from a flexible fabric material, for example, polyester. The reinforcing component of the webbing may be, for example, KEVLAR, VECTRAN, or DYNEEMA. Bicomponent yarn may be used for edges of the webbing for added abrasion resistance. The webbing may be treated to be water repellant. The webbing may include a finish to repel dirt and add additional abrasion resistance to the body of the webbing. The webbing is ultraviolet (UV) resistant, without loss of strength, to withstand 1000 hours of exposure to UV Type A and Type B. Suitable webbing is available from Murdock Webbing Company, Inc., 27 Foundry Street, Central Falls, R.I. 02863.

The width of belts 80, 86 is the same. The width of belts 80, 86 may be in a range of 0.25 to 12 inches, preferably in a range of 0.75 to 2 inches. The breaking strength of belts 80, 86 may be in a range of 100 to 25,000 pounds. In one embodiment, the width of belts 80, 86 is one inch, the working load is 100 pounds constant static without failure or stretch, and the breaking strength is 2000 pounds. In another embodiment, the width of belts 80, 86 is 1.75 inches, the working load is 200 pounds constant static without failure or stretch, and the breaking strength is 5000 pounds. Belts 80, 86 may be any length. Buckle end 87 of belt 86 is used to cinch or adjust the length of belt 86 between anchor end 88 and insertion part 62.

Referring to FIGS. 15A-B, anchor end 83 of belt 80 is in the form of a loop that is made by folding the webbing and then sewing and/or fusing the end of the webbing, as at 85. Carabiner 82 passes through the loop of anchor end 83. Buckle end 81 of belt 80 is in the form of a loop that is made by folding the webbing and then sewing and/or fusing the end of the webbing, as at 89. The loop of buckle end 81 passes through belt opening 3 in receiving part 1.

Referring to FIGS. 16A-B, anchor end 88 of belt 86 is in the form of a loop made by folding the webbing and sewing and/or fusing the end of the webbing, as at 90. Buckle end 87 of belt 86 passes over and around cinching bar 60 of insertion part 62 and then is folded back upon belt 87 to be grasped and used to ratchet or tighten belt 86 in a known manner.

Of course, rather than cinching bar 60 and two belt openings, insertion part 62 can include only a single belt opening, in which case buckle end 87 of belt 86 would be looped and sewn to insertion part 62. Likewise, rather than a single belt opening 3, receiving part 1 can include a central movable bar or cinching bar with two belt openings, in which case buckle end 81 of belt 80 would be not be looped and sewn, but would be a free end used to ratchet or tighten belt 80.

Belt 80 and/or belt 86 may include one or more longitudinal slots 90. Slots 90 are edgewise openings in belts 80, 86. Slots 90 are separations of two surfaces of the webbing used to make belts 80, 86. Slots 90 are created during the webbing weaving process by interrupting the basic weaving for an interval to permit each surface of the webbing to weave as one for the desired length of slot 90, before resuming basic weaving. In the embodiment shown, there are six slots 90 in each belt 80, 86, although more or fewer slots 90 may be used. Because slots 90 open from the edges of the belt, markers, such as paint or ink circles 91 may be placed on the face and back of the belt to identify the location of one or more slots 90.

One use of slots 90 is to create a "clothesline" using belts 80, 86. After belts 80, 86 are anchored, insertion part 62 is inserted in receiving part 1, and buckle end 87 of belt 86 is pulled to tighten belts 80, 86, additional carabiners 82 may be looped through slots 90 in belts 80, 86. The carabiners 82 hanging from slots 90 may then be used as hangers for gear or equipment. Another use of slots 90 is to create an anchor for one or both of belts 80, 86.

Figure 18:
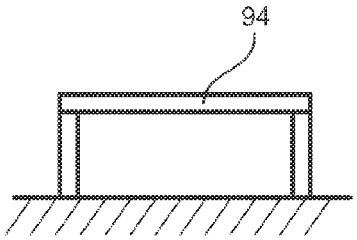
FIG. 18 is a schematic view of a support member.

As shown in FIGS. 15A and 16A, belts 80, 86 may be anchored using carabiner 82 looped through anchor 84. Anchor 84 may include an opening 92 through which, for example, a threaded fastener may be inserted and threaded into a threaded opening in a support member. Sometimes, a threaded opening or other suitable fixture is not available to anchor one or both of belt 80 or belt 86 using carabiner 82 and/or anchor 84. In that case, the belt itself may be used as an anchor. For example, belt 80 may be anchored by first removing carabiner 82 and anchor 84 from anchor end 83 of belt 80. Then, anchor end 83 is guided around a support member, such as support member 94 (FIG. 18), and anchor end 83 is then inserted into slot 90 most proximate anchor end 83. Anchor end 83 is then guided through the next most proximate slot 90 and then the next most proximate slot 90 and so on. Generally, guiding anchor end 83 through at least four slots 90 is sufficient to anchor belt 80 and prevent the load on belt 80 from pulling anchor end 83 back through slots 90 and off of support member 94.

After belts 80, 86 are anchored, using either carabiners 82 and anchors 84 or by guiding the anchor end of the belt through a plurality of slots 90, insertion part 62 is inserted into receiving part 1 and locked in the inserted state by spring-loaded latches 24, 25 bearing against surfaces 70 of holding catches 66, 68. The tie down is tightened or cinched by pulling on buckle end 87 of belt 86 until sufficient tension is reached. The tie down can be released under load by pivoting the outer ends of both latches 24, 25 inwardly. If only one of latches 24, 25 is pivoted inwardly, the insertion part 2 will not be released from the receiving part 1.

The details, materials, steps and arrangement of parts have been described and illustrated to explain the nature of the invention. It will be understood that many changes in the details, materials, steps and arrangement of parts may be made by those skilled in the art, within the principle and scope of the invention, as expressed in the appended claims and equivalents thereof.

What is claimed is:

1. A universal tie down assembly, comprising:

first and second longitudinal belts comprising reinforced webbing made from a flexible fabric material, each belt having a same width, a buckle end and an anchor end wherein each anchor end is a loop of the reinforced webbing;

at least one longitudinal slot woven into an edge of at least one of the first and second belts, the length of the at least one slot being at least as great as the width of the belts; and an open under load buckle including an insertion part having a central longitudinal axis, a belt opening for guiding a belt, and an insertion appendage extending in a direction of insertion with holding catches protruding from both sides of the insertion appendage in a direction perpendicular to the direction of insertion, a receiving part having at least one belt opening for guiding a belt and a basic body, the basic body including an insertion opening beginning at an inserting side of the basic body for inserting the insertion appendage of the insertion part in the direction of insertion, latches pivotally mounted to the basic body wherein, in a locking position with the insertion part inserted in the receiving part, the latches cooperate with the holding catches of the insertion appendage of the insertion part and retain the insertion appendage in the insertion opening of the receiving part, the insertion opening beginning at the inserting side of the basic body and forming a penetrating opening into the basic body to the belt opening, and guiding surfaces in the basic body for the holding catches of the insertion appendage of the insertion part, which limit the penetrating opening of the basic body at both sides in the perpendicular direction in an area where the penetrating opening opens into the belt opening, each holding catch including a surface for engaging a respective one of the latches, the surface including a planar portion that extends from a portion of the holding catch most distant from the central longitudinal axis inwardly towards the central longitudinal axis, the planar portion forming an acute angle with the central longitudinal axis, the surface including a rounded portion that connects the planar portion with a side of the insertion appendage, the acute angle being in a range of 55 to 62 degrees, wherein the buckle end of one of the belts is adjustably disposed in the at least one belt opening of one of the insertion part and the receiving part and the buckle end of the other of the belts forms a sewn loop that loops through the at least one belt opening of the other of the insertion part and the receiving part.

2. The assembly of claim 1, wherein the guiding surfaces are located in planes with normal surfaces thereof being aligned parallel in reference to the perpendicular direction.

3. The assembly of claim 1, wherein the insertion appendage of the insertion part protrudes from the entrance of the penetrating opening into the belt opening, in the state inserted in the receiving part, and projects into the belt opening.

4. The assembly of claim 1, wherein the latches in their locking positions are acted upon by spring elements.

5. The assembly of claim 1, wherein a wall, located between one of the lateral surfaces of the receiving part and the penetrating opening through the basic body, comprises first and second recesses, beginning at the belt opening in an area adjacent to lateral edges of a window, which is formed by the penetrating opening extending through the basic body into the belt opening.

6. The assembly of claim 1, wherein the at least one longitudinal slot includes a plurality of longitudinal slots woven into the edge of at least one of the first and second belts, the length of each of the plurality of slots being at least as great as the width of the belts.

7. The assembly of claim 6, further comprising at least one longitudinal slot woven into edges of both the first and second belts.

8. The assembly of claim 6, wherein a number of the longitudinal slots is at least four.

9. The assembly of claim 6, wherein the plurality of slots are disposed proximal the anchor end of the at least one of the first and second belts.

10. A method of anchoring the assembly of claim 9, comprising:

looping the anchor end of the at least one of the first and second belts around a support member; and then guiding the anchor end through the plurality of slots in the at least one of the first and second belts.

11. The method of claim 10, wherein the step of guiding includes guiding the anchor end through at least four slots.

12. The assembly of claim 1, wherein the belts are water repellant and include edge protection to reduce edge abrasion and premature edge failure.

13. The assembly of claim 12, wherein the belts are ultraviolet resistant, without loss of strength, to withstand 1000 hours of exposure to UV Type A and Type B.

14. The assembly of claim 1, wherein the width of the belts is in a range of 0.25 to 12 inches.

15. The assembly of claim 14, wherein the width of the belts is in a range of 0.75 inches to 2 inches.

16. The assembly of claim 14, wherein a breaking strength of the belts is in a range of 100 pounds to 25,000 pounds.

17. The assembly of claim 1, further comprising a locking carabiner for each anchor end loop, the anchor end loops being looped through the locking carabiners.

18. The assembly of claim 17, further comprising an anchor for each anchor end loop, the locking carabiners being looped through the anchors.

* * * * *